US005783258A

United States Patent [19]

Garapick

[11] Patent Number: 5,783,258

[45] Date of Patent: Jul. 21, 1998

[54] METHOD FOR TREATING LUMBER

[76] Inventor: Ronald T. Garapick, 11706 Park Point Pl., Strongsville, Ohio 44136

[21] Appl. No.: 812,733

[22] Filed: Mar. 6, 1997

[51] Int. Cl.[6] ..... B05D 3/00; B05D 1/28

[52] U.S. Cl. ..... 427/298; 427/440; 427/441; 427/442; 427/384; 514/642

[58] Field of Search ..... 427/298, 441, 427/384, 440, 442; 514/642

[56] References Cited

U.S. PATENT DOCUMENTS

| | | | |
|---|---|---|---|
| 3,653,873 | 4/1972 | Bayer | 71/67 |
| 3,789,122 | 1/1974 | Klopping | 424/245 |
| 3,912,145 | 10/1975 | Meihofer | 226/44 |
| 4,154,618 | 5/1979 | Burke | 106/27 |
| 4,174,412 | 11/1979 | Tyrer | 427/298 |
| 4,210,657 | 7/1980 | Zirngibi et al. | 424/273 R |
| 4,330,545 | 5/1982 | Zirngibi et al. | 424/263 |
| 4,532,161 | 7/1985 | Collins et al. | 427/440 |
| 4,602,011 | 7/1986 | West et al. | 514/187 |
| 4,612,255 | 9/1986 | Hein | 428/541 |
| 4,678,715 | 7/1987 | Giebeler | 427/297 |
| 4,766,113 | 8/1988 | West et al. | 514/11 B |
| 5,015,407 | 5/1991 | Read et al. | 252/108 |
| 5,096,604 | 3/1992 | Miller | 252/11 |
| 5,104,447 | 4/1992 | Stewart et al. | 106/2 |
| 5,124,344 | 6/1992 | Greiner et al. | 514/383 |
| 5,308,827 | 5/1994 | Sakamoto et al. | 504/206 |
| 5,480,679 | 1/1996 | Schmidt et al. | 427/254 |
| 5,539,024 | 7/1996 | Kirchmeyer et al. | 523/404 |
| 5,547,711 | 8/1996 | Kirchmeyer et al. | 427/386 |
| 5,614,203 | 3/1997 | DeZur et al. | 424/405 |

*Primary Examiner*—Janyce Bell

*Attorney, Agent, or Firm*—Benesch, Friedlander, Coplan & Aronoff LLP

[57] ABSTRACT

A method for treating lumber using a treatment composition having white mineral oil. The lumber is submerged in the treatment composition at atmospheric pressure or at an elevated pressure. The white mineral oil replaces moisture removed from the lumber, and thus lubricates the cell structure of the wood. The method is particularly well suited to the treatment of wood flooring blocks, since the white mineral oil is non-toxic and does not pose health or environmental hazards. A fungicide may be added to the treatment composition to inhibit the formation of mold.

35 Claims, No Drawings

METHOD FOR TREATING LUMBER

FIELD OF THE INVENTION

The present invention relates generally to a method for treating lumber, and more particularly relates to a method for treating lumber which uses mineral oil to preserve the lumber.

BACKGROUND OF THE INVENTION

Wood flooring blocks treated with creosote oil have been used during the 1900's to pave streets and bridges, and subsequently have been installed in factory floors as a wearing surface for protection of the concrete base and to provide worker comfort. Creosote oil is a yellowish to greenish-brown oily liquid obtained from coal tar, and is a registered pesticide with many environmental and health precautions. It is difficult and expensive to dispose of lumber treated with creosote oil. In addition, the handling precautions are extensive. With current environmental and health regulations regarding the handling of lumber treated with creosote oil, more and more factories are in need of a treatment to replace the toxicity of creosote oil.

Wood blocks that were installed to pave streets were in direct contact with the ground. Accordingly, creosote oil was needed to prevent the wood blocks from decaying and rotting due to exposure to the elements. However, conditions inside a factory are significantly different. In this regard, the wood blocks do not make direct contact with the ground, are not generally exposed to water, and are not usually subject to insect infestation. It should be noted that most of the wood blocks installed in factory floors are used in the northern climates, where heavy industry is located and insect infestation is not predominant.

Most lumber which has been treated to prevent rot and decay is used outdoors, where the cell structure of the lumber is continually lubricated by exposure to rainwater. In contrast, lumber which is used indoors as wood flooring blocks requires a lubricant (e.g., oil) to lubricate the cell structure, since the moisture of the lumber is removed and it is not exposed to rainwater. If the lumber is not lubricated, the wood blocks become brittle and disintegrate with the heavy use and vibration of the factory floor. Accordingly, lumber used as indoor wood flooring blocks are often treated with creosote oil, which poses the problems discussed above.

SUMMARY OF THE INVENTION

According to the present invention there is provided a method for treating lumber using white mineral oil or a white mineral oil/fungicide solution. In a first embodiment of the present invention, the lumber is treated by immersing it in the mineral oil or mineral oil/fungicide solution at atmospheric temperature. In a second embodiment of the present invention, the lumber is pressure treated by immersing it in the mineral oil or mineral oil/fungicide solution at a pressure above atmospheric pressure. The lumber remains immersed for a sufficient time to allow penetration of the oil or oil/fungicide solution into the wood.

It is an advantage of the present invention to provide a method for treating lumber, which uses a non-toxic treatment composition.

It is another advantage of the present invention to provide a method for treating lumber which does not require any special handling, storage or application requirements to treat the lumber.

It is another advantage of the present invention to provide a method for treating lumber in which rejected lumber can be inexpensively disposed of in an ordinary landfill, rather than a costly incinerator.

It is another advantage of the present invention to provide a method for treating lumber wherein the treated lumber can be transported without any special regulations.

It is another advantage of the present invention to provide a method for treating lumber which does not require any special handling requirements during the treatment process.

It is still another advantage of the present invention to provide a method for treating lumber wherein the treatment composition has no odor and no dark color.

It is still another advantage of the present invention to provide a method for treating lumber wherein the treatment composition is not carcinogenic.

It is yet another advantage of the present invention to provide a treatment composition for treating lumber which does not pose environmental or health hazards.

Still other advantages of the invention will become apparent to those skilled in the art upon a reading and understanding of the following detailed description and appended claims.

DETAILED DESCRIPTION OF THE PREFERRED EMBODIMENT

The present invention is basically directed to a method for treating lumber by allowing a sufficient amount of white mineral oil to penetrate the wood. White mineral oil is a highly refined petroleum derivative, commonly used in cosmetics. Importantly, the white mineral oil replaces the moisture in the lumber and lubricates the lumber cell structure. Accordingly, the white mineral oil stabilizes the lumber against absorption of moisture in the environment, and water damage from such occurrences as water pipe and roof leaks.

The lumber may be in the form of large pieces of wood (e.g. railroad ties having a typical dimension of 8 inches×9 inches×102 or 192 inches ) or may be cut into small wood blocks of a desired size. For instance, the wood blocks may be suitably dimensioned as wood flooring blocks having dimensions typically ranging from 2 inches (height)×3 inches (width)×6 inches (length) to 4 inches (height)×4 inches (width)×8 inches (length). It should also be appreciated that the height of the block is usually parallel to the grain of the wood. In addition, the lumber may be of any variety, including southern yellow pine or upland oak, which are particularly well suited for wood flooring blocks.

The treatment method according to a first embodiment of the present invention is basically as follows: softwood and/or hardwood lumber is kiln dried or air dried to a moisture content of between 9 and 20 percent. The lumber is then "dipped" in a vessel filled with a white mineral oil (CAS#8042-47-5) meeting United States Food and Drug Administration (FDA) regulations 21 CFR 172.878; 21 CFR 178.3620; 21 CFR 573.680; 21 CFR 178.3620(b)); 21 CFR 172.884; 21 CFR 178.3650; and 21 CFR 573.740, or alternatively filled with a solution of white mineral oil and a suitable fungicide, such as didecyl dimenthyl ammonium chloride CAS#7173-51-5 in an amount of 1–5% (by volume). The fungicide inhibits the formation of mold, and resists moisture and attacks from parasites. Didecyl dimenthyl ammonium chloride is typically used as a disinfectant, a sanitizer, a mildew preventative, and a water treatment microbiocide. Didecyl dimenthyl ammonium chloride is available from LONZA, INC. of Fairlawn, N.J. under the name BARDAC 2250/2280.

According to a second embodiment of the present invention, the lumber is pressure treated in a vessel filled with white mineral oil or a solution of the white mineral oil and a suitable fungicide, such as didecyl dimenthyl ammonium chloride CAS#7173-51-5 in an amount of 1–5% (by volume).

After the lumber has been "dipped" or pressure treated it is removed from the vessel and arranged in a manner which allows excess oil to drip therefrom for a sufficient amount of time, which will vary depending upon the size of the lumber. Accordingly, small pieces of lumber, such as a wood flooring block could require only 15 minutes for dripping, while large pieces of lumber, such as a typical railroad tie, could take up to 2 hours for dripping. Following the dripping step, the lumber can be further processed (e.g., cut, sanded, painted, etc.) and packaged for shipment.

According to a preferred embodiment of the present invention, the lumber is suitably "dipped" in the oil or oil/fungicide solution by placing the lumber in a metal cage and submerging the cage in a vessel or tank filled with the oil or oil/fungicide solution. The lumber remains submerged for a period of time sufficient to enable a desired amount of white mineral oil to penetrate into the wood. The period of time will vary depending upon the density of the lumber. For instance, southern yellow pine should soak up approximately 2 to 5 lbs. of white mineral oil per cubic foot of lumber. White mineral oil weighs approximately 6.7 to 7 lbs. per gallon. A typical soaking time will be in the range of 2 to 30 minutes for wood flooring blocks. It should be appreciated that if the lumber is over soaked, too much oil will penetrate the wood. This excess oil will leech out of the wood when the wood is exposed to high ambient temperatures.

The foregoing "dipping" procedure is preferably carried out at ambient temperature, thereby eliminating the need for any equipment or materials for heating or cooling the oil or oil/fungicide solution. However, in some cases it may be advantageous to heat the oil or oil fungicide solution to an elevated temperature (e.g., 70 to 150 degrees F.) in order to thin the oil, and thus increase the rate at which the oil penetrates the wood.

As indicated above, the method of the present invention can be performed by pressure treating the lumber. In this respect, the lumber is placed in an enclosed vessel under both vacuum and pressure conditions, or under pressure conditions only. The use of pressure for improving the penetration of various chemical compositions into all types of wood is well known in the art. In this procedure, the dried lumber is placed in a vessel which is sealed and evacuated in a regulated cycle. The cycle is related to and determined from a consideration of the species of wood. In general, the period of evacuation will vary from about 15 to 60 minutes, and the pressure within the sealed vessel is brought to a level of not less than 22" mercury at sea level. The purpose of this step is to remove moisture, as well as air and wood volatiles from the wood. Thereafter, the oil or oil/fungicide solution is introduced into the enclosed vessel (preferably while a vacuum exists in the vessel). It should be noted that the amount of oil or oil/fungicide solution should be sufficient to completely immerse the lumber. Pressurization of the vessel is then initiated and the pressure maintained at a desired level for a given period of time (e.g., a few minutes to 6 hours). Initially, the pressure within the vessel will decrease as the oil or oil/fungicide solution penetrates into the wood. The pressure can be raised to maintain a desirable level throughout the penetration period of the treatment. However, the pressure should not generally exceed 270 psi.

Stabilization of the pressure within the vessel is an indication that there is no longer any penetration of the oil or oil/fungicide solution into the wood. Accordingly, at this point, the pressure can be released, and the vessel drained. Next, a vacuum of no less than 22" of mercury at sea level may be applied to remove some of the excess oil or oil/fungicide solution. This results in the lumber having drier surfaces upon removal from the vessel. Thereafter, the vacuum is released and the lumber is removed from the vessel.

It should be noted that the process steps performed before applying pressure may also include steaming (e.g., for ice-coated or frozen lumber), heating, Boulton drying, or vapor drying. Moreover, it should be appreciated that the process parameters for pressure treating the lumber are suitably varied in order to provide optimum results for various types of wood. In particular, reference is made to the American Wood-Preservers' Association Standard C1, which provides guidelines for preservative treatment of all timber products by pressure processes. Standard C1 is fully incorporated herein by reference.

The "dipping" process is best suited for smaller pieces of lumber (e.g., wood flooring blocks), since it may be difficult or impossible to obtain complete penetration of the oil or oil/fungicide solution in large pieces of lumber. In contrast, the pressure treatment process is best suited for larger pieces of lumber (e.g. railroad ties, bridge timbers, and framing timbers), since the vacuum and pressure applied to the lumber may apply to much stress to smaller pieces of lumber, thus causing them to split, crack or break. Moreover, the pressure treatment process allows sufficient oil or oil/fungicide solution to penetrate large pieces of lumber.

The following is a specific example of the method of the present invention, conducted at atmospheric pressure in an open tank:

EXAMPLE 1

1. Southern yellow pine lumber is kiln or air dried, debarked (if necessary), and cut to size to form wood blocks.

2. The wood blocks are immersed in straight white mineral oil or a solution of 95–99% white mineral oil and 1–5% of didecyl dimethyl ammonium chloride by volume, and stirred.

3. The oil or oil/fungicide solution is maintained at ambient temperature, and the wood is immersed in the oil or oil/fungicide solution for approximately 2–5 minutes, depending on the size and quantity of wood.

4. The wood is removed from the oil or oil/fungicide solution and allowed to drip to remove excess oil or oil/fungicide solution therefrom.

Examination of wood specimens treated in accordance with the foregoing process shows good oil pickup and retention, excellent penetration of the white mineral oil into the wood, and no significant change in the original dimensions and surface texture of the wood. The white mineral oil that has penetrated into the wood exhibits resistance to moisture and breakage of the lumber. Accordingly, the white mineral oil replaces the water from the original green wood. Green wood is generally defined in the industry as wood containing 30% or more by weight of water based on the bone dry wood.

The following is a specific example of the method of the present invention, conducted at elevated pressures in an enclosed vessel:

EXAMPLE 2

1. Southern yellow pine lumber is kiln or air dried and cut to size (e.g., 4 inches×4 inches×120 inches).

2. The lumber is placed in an enclosed pressure vessel and a vacuum is applied for approximately 30 to 60 minutes.

3. Straight white mineral oil or a solution of 95–99% white mineral oil and 1–5% of didecyl dimethyl ammonium chloride by volume is added to the vessel.

4. The lumber is pressure treated in the vessel by increasing the pressure to a maximum of 150 psi, for a total pressure time of approximately 1 hour.

5. The pressure in the vessel is relieved and a vacuum is drawn for approximately 1 hour.

6. The vacuum is relieved, and the lumber is removed from the vessel and allowed to drip to remove excess oil or oil/fungicide solution therefrom.

The treatment process of the present invention provides several advantages over prior treatment methods. In this respect, the treatment contains no chemicals that are a danger to the environment or to a person handling the product. In contrast, existing treatments use petroleum-base solutions, such as diesel fuel, mineral spirits, and other combustible solvents as carriers for fungicides and pesticides. These items all contain carcinogens and have odors which evaporate into the air. Accordingly, these items pose environmental and health hazards. Moreover, these compositions and water-based solutions do not lubricate the cell structure of the wood in a dry application. In addition, since there are no volatile solvents in the present invention, the white mineral oil does not evaporate.

The invention has been described with reference to a preferred embodiment. Obviously, modifications and alterations will occur to others upon a reading and understanding of this specification. For instance, a vegetable oil (e.g., soybean, corn, sunflower or cottonseed oil) could be substituted for the white mineral oil. However, vegetable oil has the drawback that it allows parasites to thrive in the wood. It is intended that all such modifications and alterations be included insofar as they come within the scope of the appended claims or the equivalents thereof

Having thus described the invention, it is now claimed:

1. A method for treating lumber comprising:

filling a vessel with a treatment composition including white mineral oil and a fungicide having didecyl dimethyl ammonium chloride;

submerging lumber in the treatment composition for a predetermined period of time; and removing the lumber from the treatment composition.

2. A method according to claim 1, wherein said treatment composition is by volume approximately 95% to 99% white mineral oil and approximately 1% to 5% fungicide.

3. A method according to claim 1, wherein said lumber takes the form of wood blocks.

4. A method according to claim 3, wherein said wood blocks are dimensioned as wood flooring blocks.

5. A method according to claim 1, wherein said lumber is submerged in said treatment composition for at least two minutes.

6. A method according to claim 1, wherein said method further comprises the step of arranging said lumber to allow excess treatment composition to drip therefrom, after removing said lumber from said treatment composition.

7. A method for treating lumber comprising:

filling a vessel with a treatment composition including white mineral oil:

drying said lumber to a moisture content of between approximately 9% and 20%;

submerging the lumber in the treatment composition for a predetermined period of time; and removing the lumber from the treatment composition.

8. A method according to claim 7, wherein said treatment composition is by volume 100% white mineral oil.

9. A method according to claim 7, wherein said treatment composition further includes a fungicide.

10. A method according to claim 9, wherein said treatment composition is by volume approximately 95% to 99% white mineral oil and approximately 1% to 5% fungicide.

11. A method according to claim 9, wherein said fungicide is didecyl dimethyl ammonium chloride.

12. A method according to claim 7, wherein said lumber takes the form of wood flooring blocks.

13. A method according to claim 7, wherein said lumber is submerged in said treatment composition for at least two minutes.

14. A method according to claim 7, wherein said method further comprises the step of arranging said lumber to allow excess treatment composition to drip therefrom, after removing said lumber from said treatment composition.

15. A method for treating lumber comprising:

filling a vessel with a treatment composition including white mineral oil;

heating said treatment composition to a temperature in the range of 70 to 150 degrees F.;

submerging the lumber in the treatment composition for a predetermined period of time; and removing the lumber from the treatment composition.

16. A method according to claim 15, wherein said treatment composition is by volume 100% white mineral oil.

17. A method according to claim 15, wherein said treatment composition further includes a fungicide.

18. A method according to claim 17, wherein said treatment composition is by volume approximately 95% to 99% white mineral oil and approximately 1% to 5% fungicide.

19. A method according to claim 17, wherein said fungicide is didecyl dimethyl ammonium chloride.

20. A method according to claim 15, wherein said lumber takes the form of wood flooring blocks.

21. A method according to claim 15, wherein said lumber is submerged in said treatment composition for at least two minutes.

22. A method according to claim 15, wherein said method further comprises the step of arranging said lumber to allow excess treatment composition to drip therefrom, after removing said lumber from said treatment composition.

23. A method for treating lumber, comprising:

filling a vessel with a quantity of lumber;

generating a vacuum inside the vessel for a predetermined period of time;

adding a treatment composition to the vessel to immerse the lumber, wherein the treatment composition includes white mineral oil and a fungicide having didecyl dimethyl ammonium chloride;

applying pressure to the lumber in the vessel for a predetermined period of time; and removing the lumber from the treatment composition.

24. A method according to claim 23, wherein said treatment composition is by volume approximately 95% to 99% white mineral oil and approximately 1% to 5% fungicide.

25. A method according to claim 23, wherein said lumber takes the form of a timber.

26. A method according to claim 23, wherein said pressure applied to said lumber does not exceed approximately 270 psi.

27. A method according to claim 23, wherein said pressure is applied to said lumber for approximately 1 hour.

28. A method according to claim 23, wherein said method further comprises the step of arranging said lumber to allow excess treatment composition to drip therefrom, after removing said lumber from said treatment composition.

29. A method according to claim 23, wherein said lumber is dried to a moisture content of between approximately 9% and 20%, prior to filling the vessel with said lumber.

30. A non-toxic treatment composition for treating wood flooring blocks consisting of: approximately 95% to 99% white mineral oil by volume; and approximately 1% to 5% fungicide by volume.

31. A non-toxic treatment composition according to claim 30, wherein said fungicide is didecyl dimethyl ammonium chloride.

32. A method for treating lumber comprising:

filling an application means with a treatment composition including white mineral oil and a fungicide having didecyl dimethyl ammonium chloride;

applying the treatment composition to the lumber for a predetermined period of time.

33. A method according to claim 32, wherein said treatment composition is by volume approximately 95% to 99% white mineral oil and approximately 1% to 5% fungicide.

34. A method for treating lumber comprising:

drying said lumber to a moisture content of between approximately 9% and 20%;

applying a treatment composition having white mineral oil to the dried lumber for a predetermined period of time.

35. A method for treating lumber comprising:

heating a treatment composition including white mineral oil to a temperature in the range of approximately 70 to 150 degrees F.; and applying the heated treatment composition to the lumber for a predetermined period of time.

* * * * *